US007778006B2

(12) United States Patent
Stewart et al.

(10) Patent No.: US 7,778,006 B2
(45) Date of Patent: Aug. 17, 2010

(54) WIRELESS ELECTRONIC BOOSTER, AND METHODS OF BLASTING

(75) Inventors: Ronald F. Stewart, Navan (CA); David Geoffrey Anderson, St. Eugene (CA); Michael J. McCann, Chadds Ford, PA (US)

(73) Assignee: Orica Explosives Technology Pty Ltd., Melbourne, Victoria (AU)

( * ) Notice: Subject to any disclaimer, the term of this patent is extended or adjusted under 35 U.S.C. 154(b) by 540 days.

(21) Appl. No.: 11/790,849

(22) Filed: Apr. 27, 2007

(65) Prior Publication Data

US 2008/0156217 A1 Jul. 3, 2008

Related U.S. Application Data

(60) Provisional application No. 60/795,569, filed on Apr. 28, 2006.

(51) Int. Cl.
*F23Q 7/00* (2006.01)

(52) U.S. Cl. ..... 361/248

(58) Field of Classification Search ..... 361/248
See application file for complete search history.

(56) References Cited

U.S. PATENT DOCUMENTS

| | | | |
|---|---|---|---|
| 3,166,015 | A | 1/1965 | Tuve et al. |
| 3,971,317 | A | 7/1976 | Gemmell et al. |
| 4,060,033 | A | 11/1977 | Postupack et al. |
| 4,060,034 | A | 11/1977 | Bowman et al. |
| 4,165,691 | A | 8/1979 | Bowman et al. |
| 4,312,003 | A | 1/1982 | Robbins, Jr. |
| 4,458,248 | A | 7/1984 | Lyasko |
| 4,576,093 | A | 3/1986 | Snyder |
| 4,777,880 | A | 10/1988 | Beattie et al. |
| 4,815,385 | A | 3/1989 | Kingery et al. |
| 4,860,653 | A | 8/1989 | Abouav |
| 4,884,506 | A | 12/1989 | Guerreri |
| 4,938,143 | A | 7/1990 | Thomas et al. |
| 4,998,963 | A | 3/1991 | Silvia |
| 5,038,682 | A | 8/1991 | Marsden |
| 5,173,569 | A | 12/1992 | Pallanck et al. |
| 5,392,712 | A | 2/1995 | Waldock |
| 5,585,591 | A | 12/1996 | Waldock |
| 5,596,164 | A | 1/1997 | Waldock |

(Continued)

FOREIGN PATENT DOCUMENTS

| | | |
|---|---|---|
| CA | 2147521 | 10/1995 |

(Continued)

OTHER PUBLICATIONS

Cloete, E.E. and McCrindle, R.I., "Booster for Explosives", International Society of Explosives Engineers (ISEE), Technical Information Database Complete Abstracts of the ISEE Proceedings 1999 General Proceedings, vol. 2, 1999, p. 167.

(Continued)

*Primary Examiner*—Stephen W Jackson

(57) ABSTRACT

Disclosed herein are boosters that include components sufficient for wireless communications with an associated blasting machine. In selected aspects, there are disclosed wireless electronic boosters that are self-contained and robust. Such boosters are especially suited for underground mining operations, optionally employing automated placement of boosters at a blast site.

26 Claims, 6 Drawing Sheets

U.S. PATENT DOCUMENTS

| | | | | |
|---|---|---|---|---|
| 5,714,712 | A | 2/1998 | Ewick et al. | |
| 5,780,764 | A | 7/1998 | Welch et al. | |
| 5,963,847 | A | 10/1999 | Ito et al. | |
| 6,082,264 | A | 7/2000 | Meyer et al. | |
| 6,082,265 | A | 7/2000 | Sakamoto et al. | |
| 6,112,666 | A | 9/2000 | Murray et al. | |
| 6,186,069 | B1 | 2/2001 | Dippenaar | |
| 6,247,408 | B1 | 6/2001 | Andrejkovies et al. | |
| 6,321,690 | B1 * | 11/2001 | Zilka et al. | 122/379 |
| 6,508,177 | B1 | 1/2003 | Badger et al. | |
| 6,546,873 | B1 | 4/2003 | Andrejkovics et al. | |
| 6,644,202 | B1 | 11/2003 | Duniam et al. | |
| 6,748,869 | B1 | 6/2004 | Boyer et al. | |
| 7,327,550 | B2 | 2/2008 | Meyer et al. | |
| 2004/0031411 | A1 | 2/2004 | Novotney et al. | |
| 2005/0005297 | A1 | 1/2005 | Lee | |
| 2005/0090895 | A1 | 4/2005 | Peyman | |
| 2005/0215119 | A1 | 9/2005 | Kaneko | |
| 2007/0207669 | A1 | 9/2007 | Hummel et al. | |

FOREIGN PATENT DOCUMENTS

| | | | |
|---|---|---|---|
| CA | 2367161 | | 7/2002 |
| CA | 2411819 | | 5/2003 |
| FR | 2670576 | A1 | 6/1992 |
| JP | 10-239000 | A2 | 9/1998 |
| JP | 11-289291 | A2 | 10/1999 |
| RU | 2 229 678 | C1 | 5/2004 |
| RU | 2 231 746 | C2 | 6/2004 |
| WO | WO 97/27645 | A1 | 7/1997 |
| WO | WO 01/59401 | A1 | 8/2001 |
| WO | WO 03/014045 | A2 | 2/2003 |
| WO | WO 2005/052498 | A1 | 6/2005 |
| WO | WO 2006/047823 | A1 | 5/2006 |
| WO | WO 2007/051231 | A1 | 5/2007 |
| WO | WO 2007/124539 | A1 | 11/2007 |

OTHER PUBLICATIONS

Verakis H. and Lobb T., "Evaluation of Electronic Detonators—Requirement for Shunting & Circuit Testing"—Aug. 2004 http://www.msha.gov/TECHSUPP/ACC/techreports/ShuntingCircuitTesting.pdf.

Pretoria Metal Pressings a Division of Denel (Pty) Ltd. http://www.pmp.co.za/detonics.htm.

Excerpts from IME SLPs on Electronic Initiation Systems http://www.ime.org/files/Guidelines/IMEesg.pdf.

i-kon™ Digital Energy Control System http://www.i-konsystem.com/USER/oz_prodinfo_english.pdf.

Verakis H. and Lobb T., "Evaluation of Electronic Detonators—Requirement for Shunting & Circuit Testing"—Aug. 2004 http://www.msha.gov/TECHSUPP/ACC/techreports/ShuntingCircuitTesting.pdf.

i-kon™ Digital Energy Control System—Frequently Asked Questions http://www.i-konsystem.com/html2/faq1.html.

Value Beyond Blasting—The Apex™ Gold System http://www.oricaminingservices.com/default.asp?RegionID=4&LangID=1&id=761.

Cast Booster http://www.infomine.com/index/suppliers/Dyno_Nobel_Inc..html#SupplierProdListCastBooster Stinger : http://www.dynonobel.com/NR/rdonlyres/7B94F0EF-0B44-43B2-ACA0-EBD966D126C5/0/CastBoosterStinger.p Cast Booster Slider : http://www.dynonobel.com/NR/rdonlyres/C08A72FB-CD08-429F-AE95-A2ADD18B5608/0/CastBoosterDSSeries.pdf Detonator Sensitive: http://www.dynonobel.com/NR/rdonlyres/F268A8ED-08FA-474F-AE2B-AA99684E138B/0/CastBoosterCSeries.pdf.

i-kon Case study—open cast coal http://www.i-konsystem.com/html2/index.html (select study cases).

Patent Abstracts of Japan, 11-289291, "Booster Device", Oct. 19, 1999, Soga Tomio.

Patent Abstracts of Japan, 10-239000, "Remote Triggering Device", Sep. 11, 1998, Yamamura Shigeru et al.

* cited by examiner

WIRELESS ELECTRONIC BOOSTER, AND METHODS OF BLASTING

CROSS-REFERENCE TO RELATED APPLICATION

This application claims the priority right of prior U.S. patent application Ser. No. 60/795,569 filed on Apr. 28, 2006 by applicants herein.

FIELD OF THE INVENTION

The invention relates to the field of wireless blasting, apparatuses and components thereof, for effecting blasting employing wireless communication, and methods of blasting employing such apparatuses and components thereof.

BACKGROUND TO THE INVENTION

In mining operations, the efficient fragmentation and breaking of rock by means of explosive charges demands considerable skill and expertise. In most mining operations explosive charges, including boosters, are placed at predetermined positions near or within the rock. The explosive charges are then actuated via detonators having predetermined time delays, thereby providing a desired pattern of blasting and rock fragmentation. Traditionally, signals are transmitted to the detonators from an associated blasting machine via non-electric systems employing low energy detonating cord (LEDC) or shock tube. Alternatively, electrical wires may be used to transmit more sophisticated signals to and from electronic detonators. For example, such signaling may include ARM, DISARM, and delay time instructions for remote programming of the detonator firing sequence. Moreover, as a security feature, detonators may store firing codes and respond to ARM and FIRE signals only upon receipt of matching firing codes from the blasting machine. Electronic detonators can be programmed with time delays with an accuracy of 1 ms or less.

The establishment of a wired blasting arrangement involves the correct positioning of explosive charges within boreholes in the rock, and the proper connection of wires between an associated blasting machine and the detonators. The process is often labour intensive and highly dependent upon the accuracy and conscientiousness of the blast operator. Importantly, the blast operator must ensure that the detonators are in proper signal transmission relationship with a blasting machine, in such a manner that the blasting machine at least can transmit command signals to control each detonator, and in turn actuate each explosive charge. Inadequate connections between components of the blasting arrangement can lead to loss of communication between blasting machines and detonators, and therefore increased safety concerns. Significant care is required to ensure that the wires run between the detonators and an associated blasting machine without disruption, snagging, damage or other interference that could prevent proper control and operation of the detonator via the attached blasting machine.

Wireless blasting systems offer the potential for circumventing these problems, thereby improving safety at the blast site. By avoiding the use of physical connections (e.g. electrical wires, shock tubes, LEDC, or optical cables) between detonators, and other components at the blast site (e.g. blasting machines) the possibility of improper set-up of the blasting arrangement is reduced. Another advantage of wireless blasting systems relates to facilitation of automated establishment of the explosive charges and associated detonators at the blast site. This may include, for example, automated detonator loading in boreholes, and automated association of a corresponding detonator with each explosive charge, for example involving robotic systems. This would provide dramatic improvements in blast site safety since blast operators would be able to set up the blasting array from entirely remote locations. However, such systems present formidable technological challenges, many of which remain unresolved. One obstacle to automation is the difficulty of robotic manipulation and handling of blast apparatus components at the blast site, particularly where the components require tieing-in or other forms of hook up to electrical wires, shock tubes or the like. Wireless communication between components of the blasting apparatus may help to circumvent such difficulties, and are clearly more amenable to application with automated mining operations.

Progress has been made in the development apparatuses and components for establishment of a wireless blasting apparatus at a blast site. Nonetheless, existing wireless blasting systems still present significant safety concerns, and improvements are required if wireless blasting systems are to become a more viable alternative to traditional "wired" blasting systems.

SUMMARY OF THE INVENTION

It is an object of the present invention, at least in preferred embodiments, to provide a booster that is capable of wireless communication with an associated blasting machine.

It is another object of the present invention, at least in preferred embodiments, to provide a wireless electronic booster.

It is yet another object of the present invention, at least in preferred embodiments, to provide a method for blasting involving the use of a wireless electronic booster.

It is yet another object of the present invention, at least in preferred embodiments, to provide a method for wireless communication between a blasting machine and at least one booster.

It is an object of the present invention, at least in preferred embodiments, to provide a booster or corresponding blasting apparatus comprising a booster, wherein the booster is suitable for placement at the blast site via robotic means.

In one aspect the present invention provides an electronic booster for use in connection with a blasting machine, said blasting machine controlling said electronic booster via at least one wireless command signal, the electronic booster comprising:

a detonator comprising a firing circuit and a base charge;

an explosive charge in operative association with said detonator, such that actuation of said base charge via said firing circuit causes actuation of said explosive charge;

a transceiver for receiving and processing said at least one wireless command signal from said blasting machine, said transceiver in signal communication with said firing circuit such that upon receipt of a command signal to FIRE said firing circuit causes actuation of said base charge and actuation of said explosive charge.

In another aspect the invention provides for a use of an electronic booster of the invention in a mining operation.

In another aspect there is provided a method of blasting rock at a blast site, the method comprising the steps of:

placing at least one electronic booster of the invention at a desired position at the blast site, such that each booster is under the control of an associated blasting machine; and transmitting from said at least one blasting machine to said at least one booster, a command signal to FIRE.

In another aspect of the invention there is provided a method of establishing and controlling a blasting apparatus at a blast site, the method comprising the steps of:

providing at least one booster of the invention, together with at least one blasting machine;

positioning the at least one booster at a blast site each in wireless signal communication with at least one of said at least one blasting machine, each booster optionally in association with an explosive charge;

transmitting to each booster from said associated blasting machine, at least one wireless command signal, thereby to control the at least one booster, said at least one wireless command signal optionally including at least one wireless command signal to FIRE, thereby causing actuation of the at least one booster.

In other aspects of the invention, the booster may be utilized in any of the methods for communication between components of a blasting apparatus, or in any of the methods for blasting, disclosed in co-pending U.S. patent application No. 60/795,586 filed Apr. 28, 2006 entitled "Methods of controlling components of a blasting apparatus, and methods of blasting", or co-pending U.S. application No. 60/813,361 filed Jun. 14, 2006 entitled "Methods of controlling components of blasting apparatuses, blasting apparatuses and components thereof", both of which are incorporated herein by reference.

The invention also encompasses an antenna for receiving at least one wireless command signal from an associated blasting machine, the antenna having a configuration suitable to receive said at least one wireless command signal from any direction. The invention also encompasses an electronic booster as previously described, further comprising an antenna of the invention.

Figure 1:
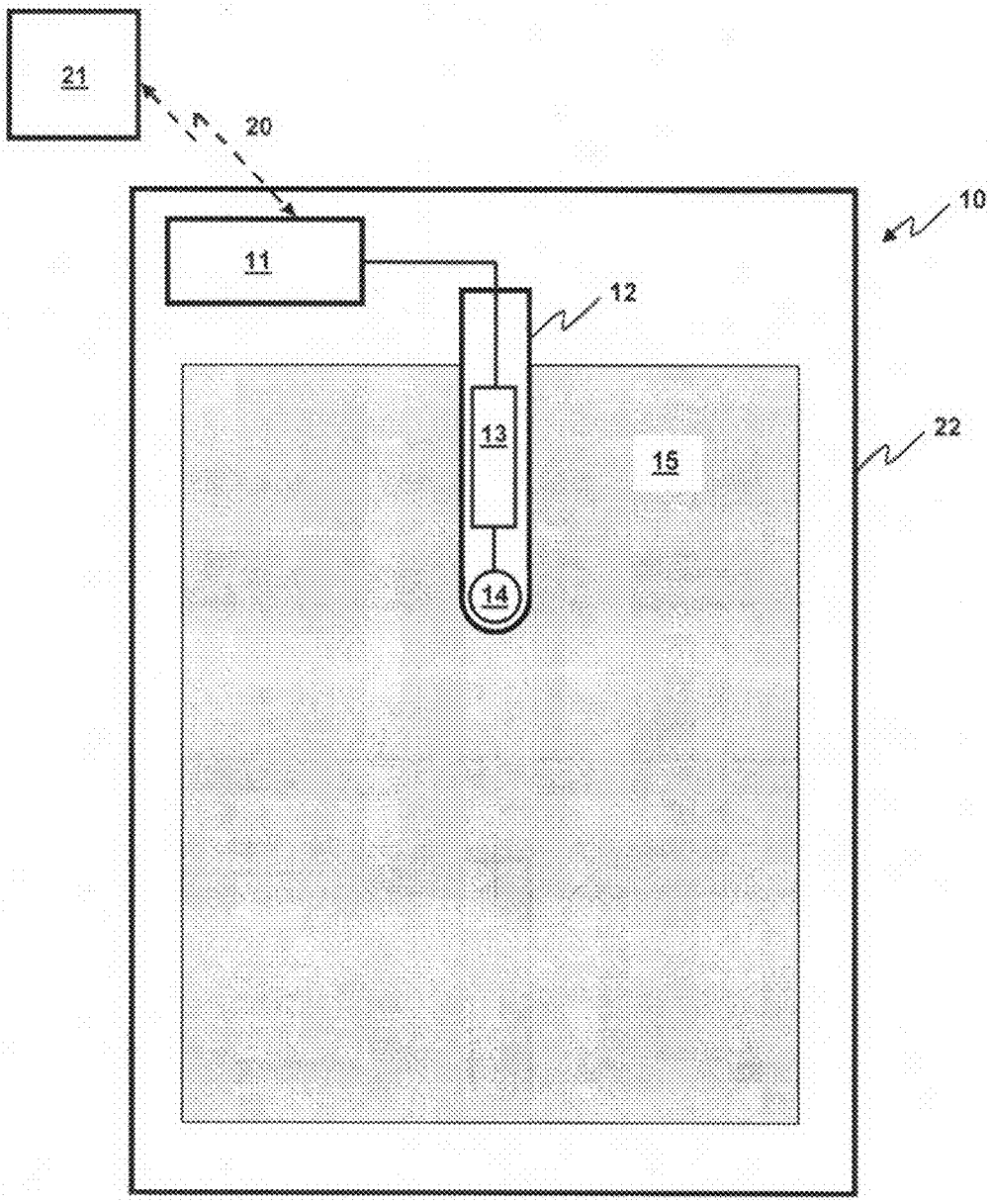
FIG. 1 schematically illustrates a preferred embodiment of a booster of the present invention.

DEFINITIONS:

Active power source: refers to any power source that can provide a continuous or constant supply of electrical energy. This definition encompasses devices that direct current such as a battery or a device that provides a direct or alternating current. Typically, an active power source provides power to a command signal receiving and/or processing means, to permit reliable reception and interpretation of command signals derived from a blasting machine.

Automated/automatic blasting event: encompasses all methods and blasting systems that are amenable to establishment via remote means for example employing robotic systems at the blast site. In this way, blast operators may set up a blasting system, including an array of detonators and explosive charges, at the blast site from a remote location, and control the robotic systems to set-up the blasting system without need to be in the vicinity of the blast site.

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Blasting machine: any device that is capable of being in signal communication with electronic detonators, for example to send ARM, DISARM, and FIRE signals to the detonators, and/or to program the detonators with delay times and/or firing codes. The blasting machine may also be capable of receiving information such as delay times or firing codes from the detonators directly, or this may be achieved via an intermediate device to collect detonator information and transfer the information to the blasting machine.

Booster: refers to any device of the present invention that can receive wireless command signals from an associated blasting machine, and in response to appropriate signals such as a wireless signal to FIRE, can cause actuation of an explosive charge that forms an integral component of the booster. In this way, the actuation of the explosive charge may induce actuation of an external quantity of explosive material, such as material charged down a borehole in rock. In selected embodiments, a booster may comprise the following non-limiting list of components: a detonator comprising a firing circuit and a base charge;

an explosive charge in operative association with said detonator, such that actuation of said base charge via said firing circuit causes actuation of said explosive charge; a transceiver for receiving and processing said at least one wireless command signal from said blasting machine, said transceiver in signal communication with said firing circuit such that upon receipt of a command signal to FIRE said firing circuit causes actuation of said base charge and actuation of said explosive charge.

Central command station—any device that transmits signals via radio-transmission or by direct connection, to one or more blasting machines. The transmitted signals may be encoded, or encrypted. Typically, the central blasting station permits radio communication with multiple blasting machines from a location remote from the blast site.

Charge/charging: refers to a process of supplying electrical power from a power supply to a charge storage device, with the aim of increasing an amount of electrical charge or energy stored by the charge storage device. As desired in preferred embodiments, the charge in the charge storage device surpasses a threshold sufficiently high such that discharging of the charge storage device via a firing circuit causes actuation of a base charge associated with the firing circuit.

Charge storage device: refers to any device capable of storing electric charge or energy. Such a device may include, for example, a capacitor, diode, rechargeable battery or activatable battery. At least in preferred embodiments, the potential difference of electrical energy used to charge the charge storage device is less or significantly less than the potential difference of the electrical energy upon discharge of the charge storage device into a firing circuit. In this way, the charge storage device may act as a voltage multiplier, wherein the device enables the generation of a voltage that exceeds a predetermined threshold voltage to cause actuation of a base charge connected to the firing circuit.

Clock: encompasses any clock suitable for use in connection with a wireless detonator assembly and blasting system of the invention, for example to time delay times for detonator actuation during a blasting event. In particularly preferred embodiments, the term clock relates to a crystal clock, for example comprising an oscillating quartz crystal of the type that is well know, for example in conventional quartz watches and timing devices. Crystal clocks may provide particularly accurate timing in accordance with preferred aspects of the invention, and their fragile nature may in part be overcome by the teachings of the present application.

Electromagnetic energy: encompasses energy of all wavelengths found in the electromagnetic spectra. This includes wavelengths of the electromagnetic spectrum division of γ-rays, X-rays, ultraviolet, visible, infrared, microwave, and radio waves including UHF, VHF, Short wave, Medium Wave, Long Wave, VLF and ULF. Preferred embodiments use wavelengths found in radio, visible or microwave division of the electromagnetic spectrum.

Explosive charge: includes any discreet portion of an explosive substance contained or substantially contained within a booster of the present invention. The explosive charge is typically of a form and sufficient size to receive energy derived from the actuation of a base charge of a detonator, thereby to cause ignition of the explosive charge. Where the explosive charge is located adjacent or near to a further quantity of explosive material, such as for example explosive material charged into a borehole in rock, then the ignition of the explosive charge may, under certain circumstances, be sufficient to cause ignition of the entire quantity of explosive material, thereby to cause blasting of the rock. The chemical constitution of the explosive charge may take any form that is known in the art, most preferably the explosive charge may comprise TNT or pentolite.

Explosive material: refers to any quantity and type of explosive material that is located outside of a booster of the present invention, but which may be in operable association with the booster, such that ignition of the explosive charge within the booster causes subsequent ignition of the explosive material. For example, the explosive material may be located or positioned down a borehole in the rock, and a booster may be located in operative association with the explosive material down or near to the borehole. In preferred embodiments the explosive material may comprise pentolite or TNT.

Filtering: refers to any known filtering technique for filtering received signal information from noise such as background noise or interference. Is selected examples filtering may employ a device for excluding signals having a frequency outside a predetermined range. In preferred embodiments the filter may be, for example, a band pass filter. However, other filters and filtering techniques may be used in accordance with any methods or apparatuses of the invention. The filter may be passive, active, analog, digital, discrete-time (sampled), continuous-time, linear, non-linear or any other type known in the art.

Forms of energy: In accordance with the present invention, "forms" of energy may take any form appropriate for wireless communication and/or wireless charging of the detonators. For example, such forms of energy may include, but are not limited to, electromagnetic energy including light, infrared, radio waves (including ULF), and microwaves, or alternatively make take some other form such as electromagnetic induction or acoustic energy. In addition, "forms" of energy may pertain to the same type of energy (e.g. light, infrared, radio waves, microwaves etc.) but involve different wavelengths or frequencies of the energy.

"Keep alive" signal: refers to any signal originating from a blasting machine and transmitted to a wireless detonator assembly, either directly or indirectly (e.g. via other components or relayed via other wireless detonator assemblies), that causes a charge storage device of the wireless detonator assembly to be charged by a power source and/or to retain charge already stored therein. In this way, the charge storage device retains sufficient charge so that upon receipt of a signal to FIRE, the charge is discharged into the firing circuit to cause a base charge associated with the firing circuit to be actuated. The "keep alive" signal may comprise any form of suitable energy identified herein. Moreover, the "keep alive" signal may be a constant signal, such that the wireless detonator assembly is primed to FIRE at any time over the duration of the signal in response to an appropriate FIRE signal. Alternatively, the "keep alive" signal may comprise a single signal to prime the wireless detonator assembly to FIRE at any time during a predetermined time period in response to a signal to FIRE. In this way, the wireless detonator assembly may retain a suitable status for firing upon receipt of a series of temporally spaced "keep alive" signals.

Logger/Logging device: includes any device suitable for recording information with regard to a booster of the present invention, or a detonator contained therein. The logger may transmit or receive information to or from a booster of the invention or components thereof. For example, the logger may transmit data to a booster such as, but not limited to, booster identification codes, delay times, synchronization signals, firing codes, positional data etc. Moreover, the logger may receive information from a booster including but not limited to, booster identification codes, firing codes, delay times, information regarding the environment or status of the booster, information regarding the capacity of the booster to communicate with an associated blasting machine (e.g. through rock communications). Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator, and preferably means to transfer this data to a central command station or one or more blasting machines. One principal function of the logging device, is to read the booster so that the booster or detonator contained therein can be "found" by an associated blasting machine, and have commands such as FIRE commands directed to it as appropriate. A logger may communicate with a booster either by direct electrical connection (interface) or a wireless connection of any type known in the art, such as for example short range RF, infrared, Bluetooth etc.

Micro-nuclear power source: refers to any power source suitable for powering the operating circuitry, communications circuitry, or firing circuitry of a detonator or wireless detonator assembly according to the present invention. The nature of the nuclear material in the device is variable and may include, for example, a tritium based battery.

Passive power source: includes any electrical source of power that does not provide power on a continuous basis, but rather provides power when induced to do so via external stimulus. Such power sources include, but are not limited to, a diode, a capacitor, a rechargeable battery, or an activatable battery. Preferably, a passive power source is a power source that may be charged and discharged with ease according to received energy and other signals. Most preferably the passive power source is a capacitor.

Power supply (without recitation of the power source being an 'active power source' or a 'passive power source'): refers to a power supply that is capable of supplying a fairly constant supply of electrical power, or at least can provide electrical power as and when required by connected components. For example, such power supplies may include but are not limited to a battery.

Preferably: identifies preferred features of the invention. Unless otherwise specified, the term preferably refers to preferred features of the broadest embodiments of the invention, as defined for example by the independent claims, and other inventions disclosed herein.

Top-box: refers to any device forming part of a wireless detonator assembly that is adapted for location at or near the surface of the ground when the wireless detonator assembly is in use at a blast site in association with a bore-hole and explosive charge located therein. Top-boxes are typically located above-ground or at least in a position in, at or near the borehole that is more suited to receipt and transmission of wireless signals, and for relaying these signals to the detonator down the borehole. In preferred embodiments, each top-box comprises one or more selected components of the wireless detonator assembly of the present invention.

Transceiver: refers to any device that can receive and/or transmit wireless signals. Although the terms transceiver traditionally encompasses a device that can both transmit and receive signals, a transceiver when used in accordance with the present invention includes a device that can function solely as a receiver of wireless signals, and not transmit wireless signals or which transmits only limited wireless signals. For example, under specific circumstances the transceiver may be located in a position where it is able to receive signals from a source, but not able to transmit signals back to the source or elsewhere. In very specific embodiments, where the transceiver forms part of a booster located underground, the transceiver may be able to receive signals through-rock from a wireless source located above a surface of the ground, but be unable to transmit signal back through the rock to the surface. In these circumstances the transceiver optionally may have the signal transmission function disabled or absent. In other embodiments, the transceiver may transmit signals only to a logger via direct electrical connection, or alternatively via short-range wireless signals.

Wireless: refers to there being no physical wires (such as electrical wires, shock tubes, LEDC, or optical cables) connecting the detonator of the invention or components thereof to an associated blasting machine or power source.

Wireless booster: In general the expression "wireless booster" or "electronic booster" encompasses a device comprising a detonator, most preferably an electronic detonator (typically comprising at least a detonator shell and a base charge) as well as means to cause actuation of the base charge upon receipt by said booster of a signal to FIRE from at least one associated blasting machine. For example, such means to cause actuation may include a transceiver or signal receiving means, signal processing means, and a firing circuit to be activated in the event of a receipt of a FIRE signal. Preferred components of the wireless booster may further include means to transmit information regarding the assembly to other assemblies or to a blasting machine, or means to relay wireless signals to other components of the blasting apparatus. Such means to transmit or relay may form part of the function of the transceiver. Other preferred components of a wireless booster will become apparent from the specification as a whole.

DETAILED DESCRIPTION OF THE PREFERRED EMBODIMENTS

The inventors have succeeded in the development of wireless electronic boosters for use in mining operations, each wireless booster being capable of wireless communication with a corresponding blasting machine. In preferred embodiments, the wireless electronic boosters may comprise a detonator including a firing circuit and a base charge, an explosive material in operative association with the base charge such that actuation of the base charge causes actuation of the explosive charge. In preferred embodiments, the detonator may include features that substantially avoid the risk of accidental detonator actuation resulting from inappropriate use of operating power for communications. In this way, a blast operator working at a blast site can position boosters, optionally associate the boosters with explosive materials at the blast site, and move away from the blasting site, without the need to establish and lay a multitude of wired connections between the components of the blasting system. Not only does this reduce the time and cost of the blasting operation, but the safety of the overall system is improved.

Wireless blasting systems help circumvent the need for complex wiring between components of a blasting apparatus at the blast site, and the associated risks of improper placement, association and connection of the components of the blasting system.

Through careful investigation, and significant inventive ingenuity, the inventors have developed a booster that includes components required for wireless communication with an associated blasting machine, such that the booster can be controlled, and optionally actuated, upon receipt of appropriate wireless signals from the blasting machine. For example, in selected embodiments the booster may comprise:

a detonator comprising a firing circuit and a base charge;

an explosive charge in operative association with the detonator, such that actuation of said base charge via said firing circuit causes actuation of said explosive charge;

a transceiver for receiving and processing said at least one wireless command signal from said blasting machine, said transceiver in signal communication with said firing circuit such that upon receipt of a command signal to FIRE said firing circuit causes actuation of said base charge and actuation of said explosive charge.

In this way, the booster may be positioned to receive the wireless command signal or signals from an associated blasting machine, and upon actuation the booster may cause ignition of explosive material located near or adjacent the booster. For example, the booster may be located in a borehole positioned in the rock, the borehole containing a quantity of explosive material for the blasting event. Typically, a series of boosters may be used such that each booster is associated with a single borehole. In selected embodiments, the detonator of the booster may be an electronic detonator that is programmable in a manner well known in the art. For example, each electronic detonator may be programmed with delay times, firing codes etc. to enable a secure blasting event with carefully timed actuation of boosters and associated explosive charges. Such electronic detonators can be programmed with delay times of 1 ms or less.

In other embodiments, the booster may include an antennae useful for receiving wireless signals from, or sending wireless signals to, other components of the blasting apparatus such as for example a blasting machine. Such an antennae may, for example, trail from within a borehole to an opening of the borehole thereby to facilitate receipt or transmission of wireless signals over a surface of the ground. In other embodiments, the antennae may take the form of an internal component of the booster, particularly where the booster is required to be robust and resistant to shocks or impacts.

In selected embodiments of the invention, the booster of the present invention may be adapted for use in underground mining operations. For example, the components of the booster may be contained within some form of casing. The casing may take the form of a protective casing comprising a material and structure suitable to at least partially protect the internal components of the booster from external physical trauma, impact, shock etc. In this way, the casing may enable the booster to form a substantially robust, self-contained unit that is well suited for difficult mining operations where the components of the blasting apparatus are dropped, crushed, knocked or in some way exposed to physical trauma.

The casing, while robust, may optionally include means to allow access to the internal components of the booster, for example to check, service or replace such components as required. Such access means may include a door or access panel on the casing, which may be fixed in place via any attachment means including but not limited to a hinge, flanges, screws etc.

Boosters of the present invention that include some form of robust casing are especially well suited for use in underground mining operations where placement of the boosters may be more likely to result in accidental impacting, crushing, knocking, or other physical abuse. In particular, the self-contained and robust nature of the boosters of the present invention, at least in specific embodiments, makes the boosters especially suited to automated mining operations either underground or surface mining. Placement of boosters during mining operations required care and dexterity, and handling of blasting apparatus components such as boosters by robotic systems (compared to human placement) is problematic in this regard. The boosters of the present invention, at least in selected embodiments, may be especially well suited to robotic placement. Their capacity for wireless signal communication avoids the need for wires or signals transmission lines, or the need for "tieing-in" of such lines at the blast site. Moreover, the boosters of the present invention, at least in selected embodiments, exhibit a degree of robustness that allows robotic placement at the blast site with less risk of damage to the booster and its internal components. For example, selected boosters of the present invention may include booster components held within a robust case having a shape or form adapted for robotic handling, such as grasping, manipulation, and insertion into a suitable position in the rock for the blast. For example, in underground mining operations robotic systems may work far below the surface of the earth in unpleasant or cramped conditions, operated by mine operators at the surface. The booster of the invention, at least in preferred embodiments, may function and perform well under such conditions, especially when any casing is shock absorbent and/or prevents egress of water and/or dirt into the casing. In most preferred embodiments, the booster may externally take on a simple shape and form, without external projections such as antennae that would be prone to damage during use.

The booster of the present invention may further be adapted for communication with an associated logger unit. Such logger units are known in the art for example for the purpose of logging the presence of electronic detonators, or for programming electronic detonators with data such as delay times and firing codes. A logger unit may be brought into contact with a booster of the present invention to establish direct electrical connection with the booster. Alternatively, the logger may be brought adjacent or at least into a local vicinity of a booster of the present invention to communicate via wireless means with the booster for example via local radio connection, electromagnetic signals (e.g. infrared), Bluetooth connection etc. In this way, components of the booster including an electronic detonator (where present) may undertake one-way or two-way communication with the logger. For example the logger may receive information from the booster such as:

- information regarding the booster's identity
- information regarding the booster's location
- information regarding the booster's pre-programmed delay time,
- information regarding the booster's capacity to send and/or receive signals to or from a corresponding blasting machine.

Likewise, the booster may in selected embodiments transmit information to the logger such as:

- information regarding the booster's identity
- information regarding the booster's location
- information regarding the booster's pre-programmed delay time etc.

The use of a logger may be particularly suited to underground mining operations. For example, it may be difficult to transmit such complex information (as listed above) to a booster positioned underground relative to a blasting machine located above-ground. Such complex signals may be susceptible to disruption or interference, for example during transmission of the signals through rock and/or water. This difficulty may be overcome, at least in part, by taking a logger underground to the positions of the boosters, and using the logger to transmit or receive such complex signals to or from the boosters whilst in situ at the blast site. In the case of an automated blasting event, the logger may be located for example on a robotic system designed for underground use. Such a robotic system may serve as dual function as a means both for placement of the booster, as well as logging/programming of the booster, for the blasting event. Portions of the robotic system for grasping and placing the booster can themselves be adapted for use as a logger, such that contact of the robotic system with a booster serves for logging/programming as well as booster placement at the blast site. Alternatively, the robotic system may include grasping or placement means solely for detonator placement, and a logger for short-range wireless communications. Alternatively, a blasting machine or logger may receive or transmit information to a booster of the present invention prior to its placement at the blast site either during surface mining or underground mining operations.

As previously mentioned, the booster of the present invention may be adapted for underground use. For this purpose, special consideration may be given to wireless signal communication between a blasting machine and boosters located underground, at least to ensure proper transmission and differentiation of basic wireless command signals from a blasting machine to a booster. For example, a booster of the present invention must at least be able to receive and "understand" one or more basic signals received from the blasting machine, such as ARM, DISARM, FIRE, SHUT-DOWN signals. In preferred embodiments, the booster of the invention may comprise a transceiver capable of receiving low frequency radio signals, preferably having a frequency of 20-2500 Hz, more preferably 100-2000 Hz, most preferably having a frequency of 200-1200 Hz. It is known in the art that such low frequency radio signals can penetrate rock and water deposits in a manner often sufficient for through-rock communications, whilst allowing for a degree of signal complexity for successful differentiation of basic signals. Such basic signals may include, but are not limited to, signals to ARM, DISARM, FIRE, ACTIVATE, or DEACTIVE the booster, and may also extend to more complex signals such as delay times and firing codes.

The booster of the present invention may incorporate any known technology for the improvement of the safety and/or security of blasting systems, detonators, electronic detonators, wireless communications etc. For example, in preferred embodiments the booster may employ the use of an electronic detonator or electronic detonator assembly that is "intrinsically safe" as described for example in U.S. Pat. No. 6,644,202 issued Nov. 11, 2003, which is incorporated herein by reference. Moreover, the booster of the invention may further include the use of a wireless detonator assembly that includes a power source for running wireless communications means having insufficient power to trigger base charge actuation via the firing circuit, as well as a chargeable passive power source connected to the firing circuit. Preferably, the passive power source remains charged upon receipt by the detonator of a "keep alive" signal. Such a wireless detonator assembly is described for example in WO2006/047823 published May 11, 2006, which is also incorporated herein by reference.

Figure 2:
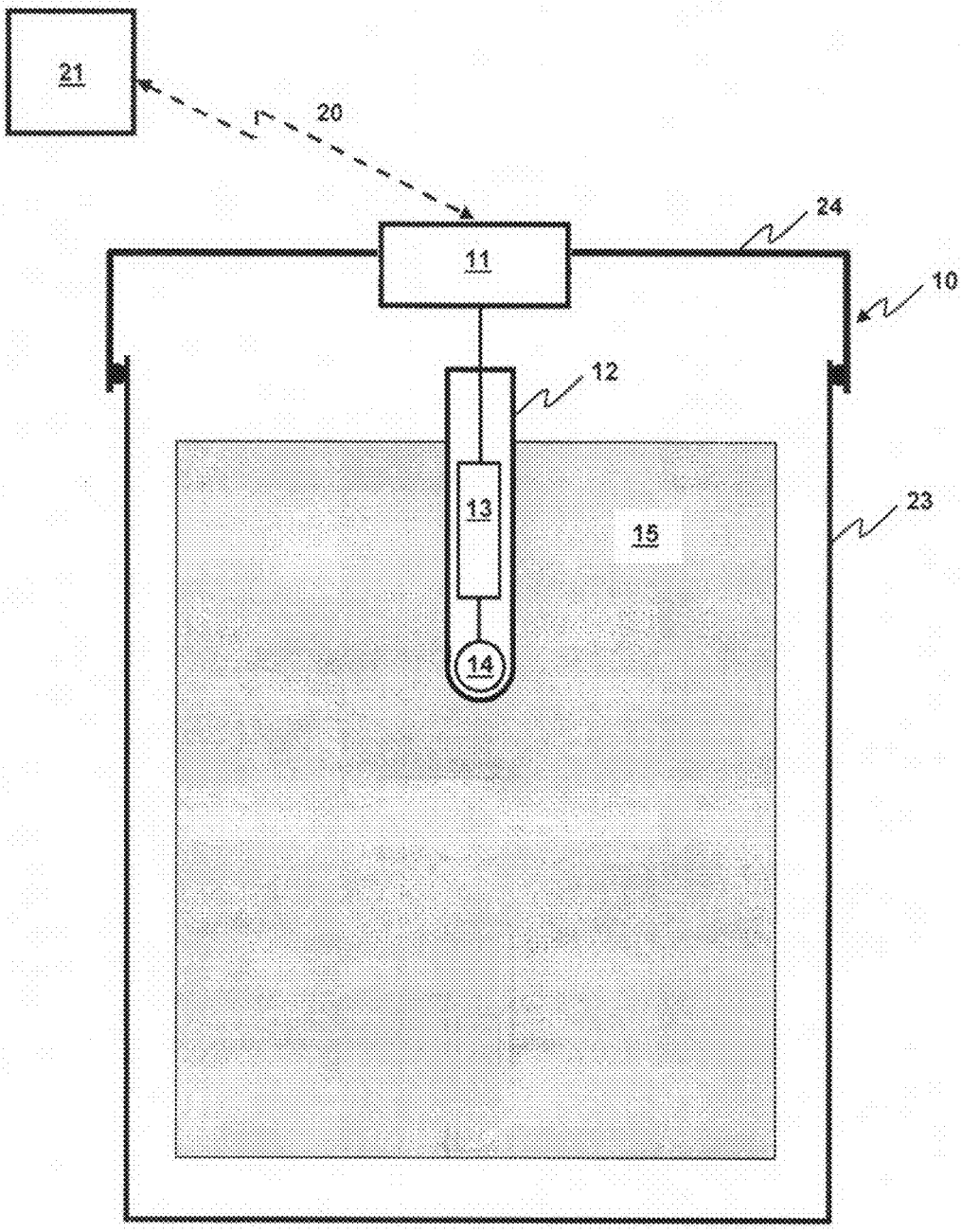
FIG. 2 schematically illustrates a preferred embodiment of a booster of the present invention.

One embodiment of a preferred booster of the present invention is illustrated with reference to FIG. 1. The booster shown generally at 10 includes a transceiver 11 for receiving and/or transmitting wireless signals 20 to and/or from a blasting machine 21. The booster 10 further includes a detonator 12 including a firing circuit 13, and a base charge 14. The base charge 14 is positioned such that actuation thereof causes actuation of an explosive charge 15. In selected embodiments, casing 22 may comprise a rigid or robust material suitable for shock absorption and/or preventing egress of water and/or dirt into the internal regions of the booster. A similar embodiment is shown with reference to FIG. 2. However, in contrast to the embodiment shown in FIG. 1, the casing 10 effectively comprise two separate components, firstly cup-like portion 24 for at least retaining the explosive material 15 and optionally the detonator 12 and associated components, and secondly a lid portion 24 which engages the cup-like portion 23 preferably to form a sealed unitary booster 10. The engagement of the lid portion 24 to the cup-like portion 23 may involve for example a screw thread or snap-fit engagement. In FIG. 2, the transceiver 11 forms an integral component of lid portion 24, and electrical connection is established between the transceiver 11 and detonator 12 upon proper retention of the lid portion 24 upon cup-like portion 23. In some respects the lid portion 24 with the transceiver 11 integrated therein forms a "top-box"-like device of a wireless electronic detonator assembly, such as described in WO2006/047823 published May 11, 2006, which is incorporated herein by reference.

Although the embodiments of the booster of the invention illustrated with reference to FIGS. 1 and 2 include direct electrical connection between the components of the booster, it should be noted that such connections may be replaced with wireless connections.

The invention also relates to the use of any booster disclosed herein in a mining operation, such as a surface mining operation or an underground mining operation, optionally involving automated systems such as robotic manipulation of the booster and/or other components of the blasting apparatus.

Figure 3:
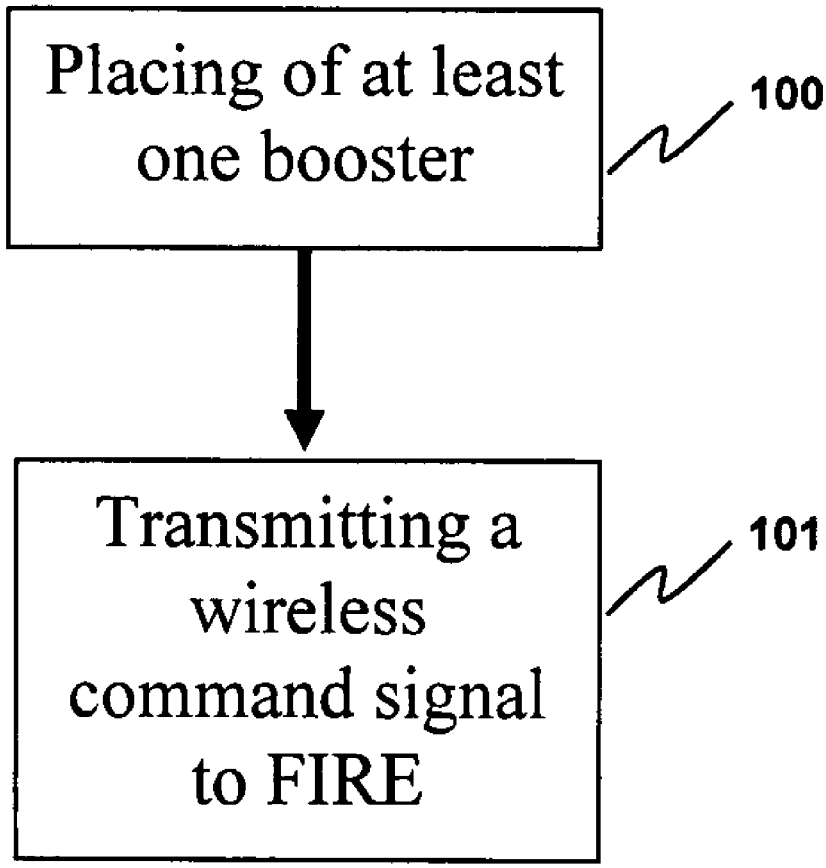
FIG. 3 illustrates the steps of a preferred method of the invention.

The invention further provides for methods of blasting involving a booster of the present invention. As outlined in FIG. 3, in their broadest sense the methods of the invention include the steps of:

placing at least one booster of the present invention at a blast site, optionally near or adjacent explosive material (step 100); and transmitting a signal to FIRE to the at least one booster, thereby to cause actuation of the explosive charge in the booster, and optionally any adjacent explosive material (step 101).

Figure 4:
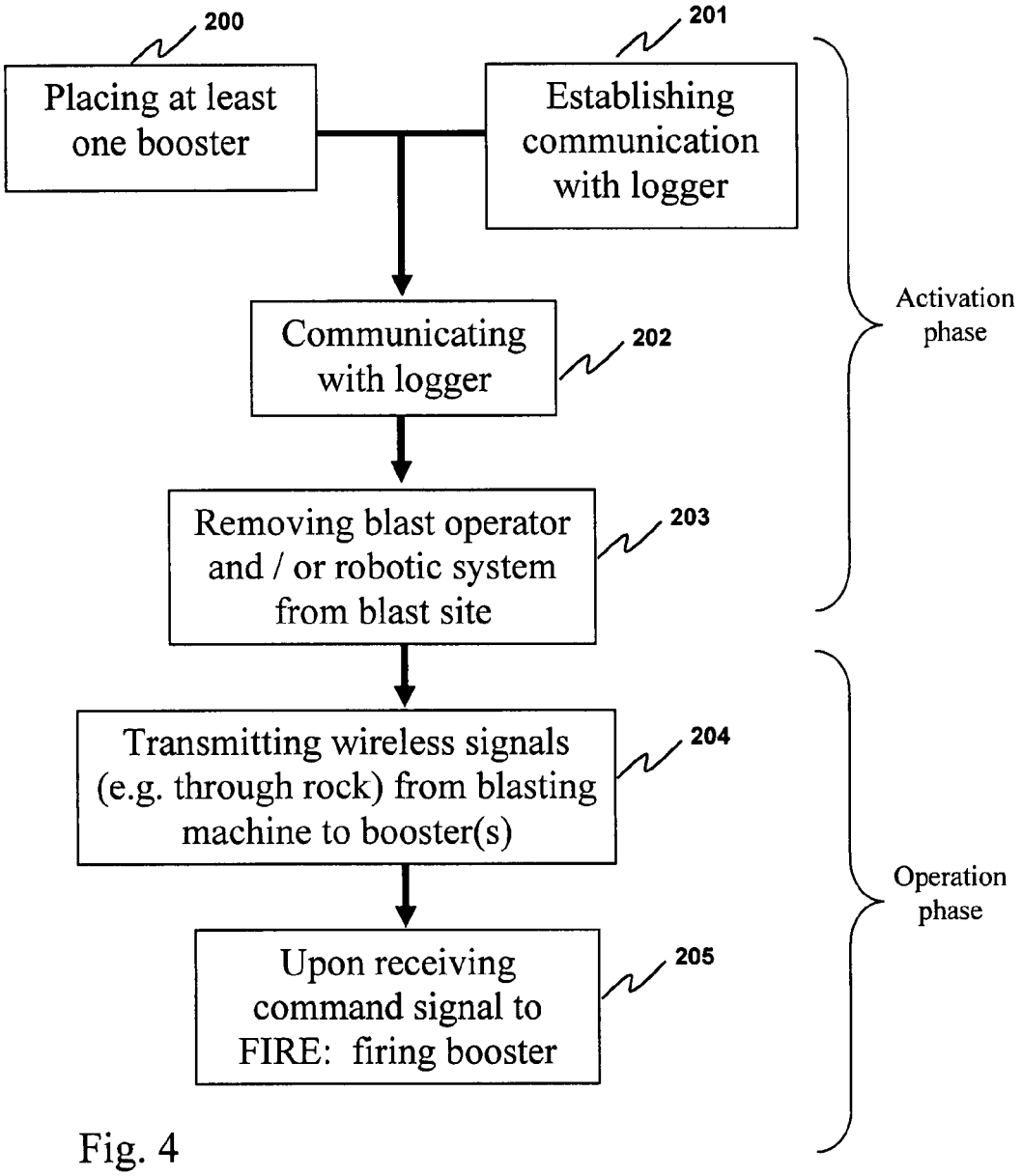
FIG. 4 illustrates the steps of a preferred method of the invention.

Turning now to FIG. 4, there is outlined a preferred method of the invention. Although the method involves several steps, it essentially involves two principle "phases". In a first "activation phase", each booster is programmed and positioned (or positioned and programmed), via for example association with a logger. In this way, the booster may be checked for its integrity and operability either before or after placement at a desired position in the rock. Moreover, data may be transferred between the logger and the booster, for example to program the booster with identification codes, delay times etc. Subsequently, in a second "operating phase", a blasting machine may communicate with the booster, for example to ARM and FIRE the booster as required. Because the booster has been pre-programmed with more complex data (e.g. delay times, identification codes, firing codes etc.) only basic signals may be transmitted from the blasting machine to the booster during the operating phase. Such basic signals may be amenable to transmission without disruption even under difficult conditions, such as through-rock transmission. In this way, the methods of the invention may be adapted for automated placement of the booster of the invention, for example using robotic systems comprising loggers integrated therein, followed by through-rock transmission of basic signals to fire the boosters. Since the boosters will already be programmed with firing codes and delay time information they may be readily able to undergo actuation in a desired firing sequence even though they have been placed underground via automated means.

With specific reference to FIG. 4, step 200 involves placement of at least one booster of the invention at the blast site (e.g. underground), and step 201 involves establishment of a useful communications link with an associated logger. Steps 200 and 201 may be conducted in any order. For example, the placement may occur prior to logger communications and vice versa. In selected embodiments, robotic placement of the booster may enable placement and logger communication simultaneously, especially where a logger is integrated into the grasping elements of the robotic system, or forms a component of the robotic system for short-range wireless communications for logging purposes.

In step 202, communication may occur between the logger and the booster. For example, the logger may read from the booster identification information for the booster, pre-programmed delay times, pre-programmed firing codes, environment or status information for the booster, or a geographical position of the booster on the blast site. Alternatively or additionally, the logger may program information into the booster such as booster identification information, firing codes, delay times, etc. The logger may also check the operability of the booster, as well as the capacity of the booster to receive signals (e.g. through-rock signals), from an associated blasting machine.

In step 203, the blast operator or robotic system conducting the placement and logging may clear the blast site. This effectively concludes the "activation phase" of the method.

In step 204 the blasting machine sends wireless command signals to the booster. Such signals may include, but are not limited to, ARM, DISARM, FIRE, SHUT-DOWN, or ACTIVATION or DEACTIVATION signals for the booster, and where possible may also include more complex signals such as booster identification codes, delay times, firing codes etc. In addition, the wireless command signals from the blasting machine may include a continuous or periodic "keep alive" signal to maintain associated boosters in an active state suitable for communication with an associated blasting machine. If a booster fails to receive a "keep alive" signal, or fails to receive a "keep alive" signal within a certain time period, the booster automatically adopts a safe-mode or inactive mode in which actuation of the detonator and associated explosive charge cannot occur, even upon receipt from the associated blasting machine of a signal to FIRE. Such a "keep alive" signal may utilize, for example, a carrier frequency suitable for through-rock transmission for underground blasting operations. In step 205 the booster may also receive a signal to FIRE, and to subsequently actuate the base charge of the detonator, as well as the explosive charge in the booster.

Although not discussed with reference to the Figures, it will be appreciated that any booster of the present invention may be further adapted to send signals back to an associated blasting machine. In the case of through rock transmission of wireless signals, such signals may preferably involve the use of low frequency radio waves as previously described. Such response signals may include, but are not limited to, a geographical position of the booster, a status or environment of the booster, information programmed into the booster such as delay times, firing codes, booster identification information.

In selected embodiments, the booster of the present invention may include an antenna to facilitate, improve, or permit the receipt of wireless signals (and optionally for the transmission of wireless signals). The antennae may be a component retained within a casing or may form a component external to a casing.

Figure 5A:
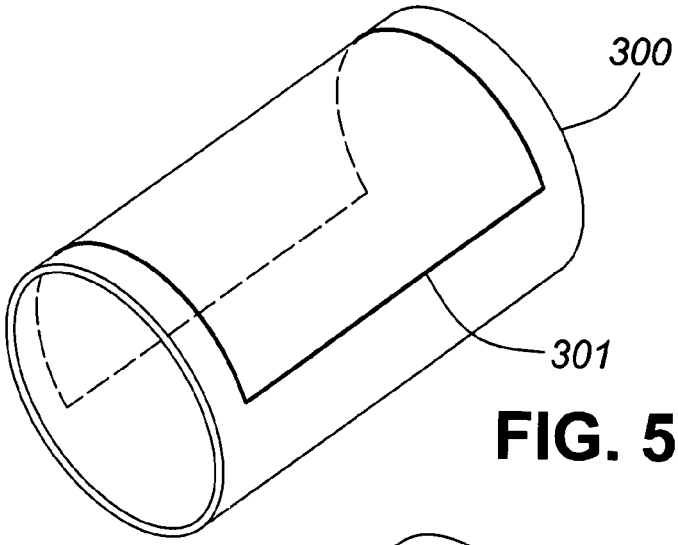
FIG. 5*a* schematically illustrates an electrical wire winding for a type of antenna that may be utilized in accordance with the wireless booster of the present invention.
Figure 5B:
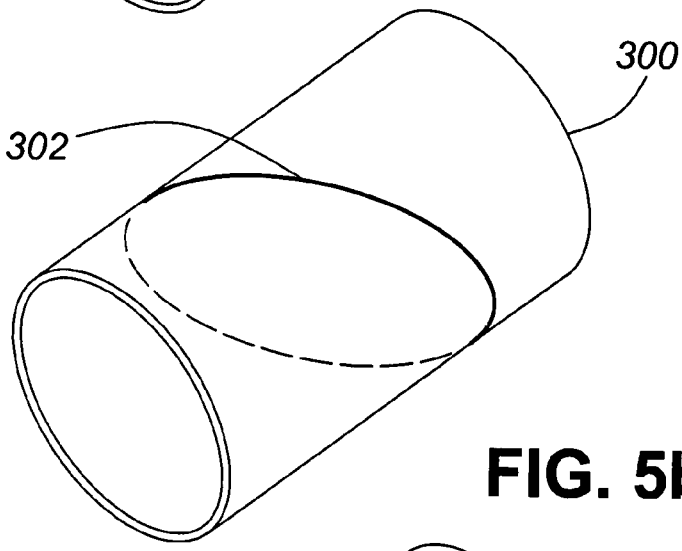
FIG. 5*b* schematically illustrates an electrical wire winding for a type of antenna that may be utilized in accordance with the wireless booster of the present invention.
Figure 5C:
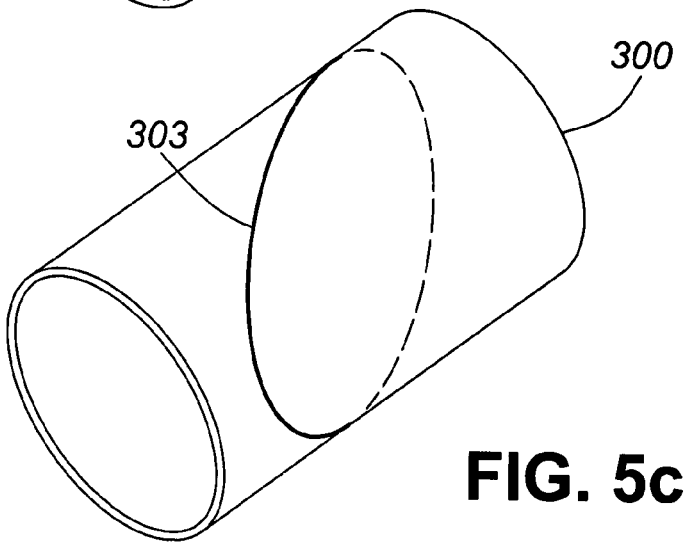
FIG. 5*c* schematically illustrates an electrical wire winding for a type of antenna that may be utilized in accordance with the wireless booster of the present invention.
Figure 6:
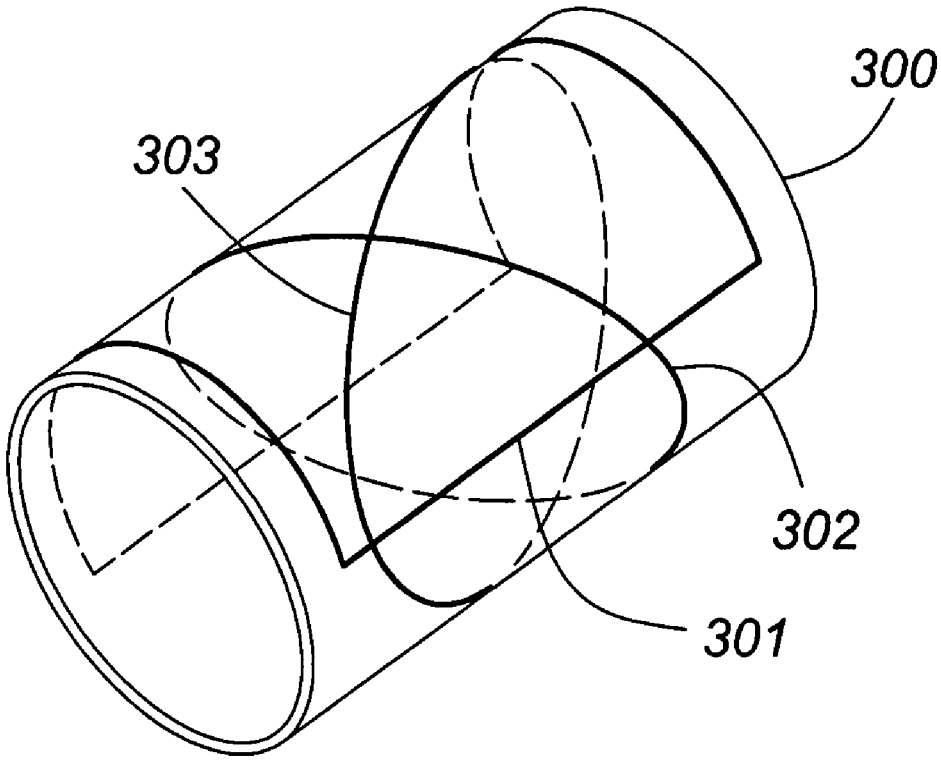
FIG. 6 illustrates a type of antenna that may be utilized in accordance with the wireless booster of the present invention, a) photographic form, and b) line drawing.

In any event, the antenna may take any shape or form that allows it to perform its required function. One particularly preferred antenna, which optionally may be used with the booster of the present invention, will now be described with reference to FIGS. 5*a, b*, and *c*, as well as FIG. 6. The triaxial antenna comprises a central core shown as 300 in FIG. 5. FIGS. a, b, and c each show a perspective view of the antenna. For simplicity, each of FIGS. 5*a, b*, and *c* shows a single winding configuration for wire about the core 300. In FIG. 5*a*, the wire is wound on the core in the configuration shown (301), whereas for FIGS. 5*b* and 5*c* the wire is wound around the core in an elliptical fashion (302, 303). The fully assembled antenna includes all three wire windings shown in FIGS. 5*a, b*, and *c*. This is shown schematically in FIG. 6. Without wishing to be bound by theory, the inventors consider the triaxial antenna configuration illustrated in FIG. 6 (and also in FIGS. 5*a, b*, and *c* in combination) to provide an antenna that can successfully receive wireless signals transmitted for example through rock from any direction above the ground. In this way, the booster of the present invention may be placed, optionally by robotic means, at desired positions underground at a blasting site, and yet the booster may be at any orientation to receive wireless signals regardless of the position(s) of the blasting machine(s) located above ground. Each of the wires in positions 301, 302, and 303 in FIGS. 5 and 6 may include from 1 to many thousands of windings depending upon the signal being received, and other considerations such as antenna weight and bulk. For example, each wire may include hundreds of winding, preferably of a fine gauge wire so that the bulk and weight of the antenna is kept within reasonable limits.

Whilst the invention has been described with reference to specific embodiments of the boosters and methods of blasting involving such boosters, such embodiments are merely intended to be illustrative of the invention and are in no way intended to be limiting. Other embodiments exist that have not been specifically described which nonetheless lie within the spirit and scope of the invention. It is the intention to include all such embodiments within the scope of the appended claims.

The invention claimed is:

1. A wireless electronic booster for use in connection with a blasting machine and for detonation of an explosive material at a blast site, said blasting machine controlling said electronic booster via at least one wireless command signal, the wireless electronic booster comprising:

an electronic detonator comprising a firing circuit and a base charge;

an explosive charge in operative association with said detonator, such that actuation of said base charge via said firing circuit causes actuation of said explosive charge which causes detonation of said explosive material;

a wireless transceiver for receiving and processing said at least one wireless command signal from said blasting machine, said transceiver in signal communication with said firing circuit such that upon receipt of a command signal to FIRE said firing circuit causes actuation of said base charge and actuation of said explosive charge; and a protective casing such that at least the detonator, explosive charge and transceiver are contained within the casing to at least partially protect the detonator, explosive charge and transceiver from shock or loading forces imposed thereupon and/or ingress of water or dirt during use.

2. The electronic booster of claim 1, wherein the detonator and the transceiver are connected via wire or crimped connection.

3. The electronic booster of claim 1, wherein the detonator and the transceiver communicate via a wireless link, optionally involving electromagnetic signals.

4. The electronic booster of claim 1, wherein the transceiver comprises:

command signal receiving and processing means for receiving and processing said at least one wireless command signal from said blasting machine;

a charge storage device for storing electrical energy;

at least one power source to power said command signal receiving and processing means, and to charge said charge storage device, each of said at least one power source capable of supplying a maximum voltage or current that is less than a threshold voltage or current to actuate said base charge via said firing circuit;

whereupon receipt by said command signal receiving and processing means of a command signal to FIRE causes said electrical energy stored in said charge storage device to discharge into said firing circuit of said detonator, said base charge actuating if a voltage or current in said firing circuit resulting from discharge of said electrical energy from said charge storage device exceeds said threshold voltage or current.

5. The electronic booster of claim 1, wherein the transceiver or said detonator further comprises a memory for recording a delay time for actuation of said base charge and a clock for counting down said delay time upon receipt by said wireless detonator assembly of a command signal to FIRE.

6. The electronic booster of claim 1, wherein said transceiver comprises an antenna at least for receiving said at least one wireless command signal from said at least one blasting machine.

7. The electronic booster of claim 1, wherein said explosive charge and said detonator are contained within a cup-like booster element, the transceiver being contained within a booster-cap adapted to engage said cup-like booster element, thereby to form said wireless electronic booster.

8. The electronic booster of claim 1, further including a logger communication component for communicating with an associated logger via direct electrical contact with said logger, or via short-range wireless communication.

9. The electronic booster of claim 8, wherein the logger logs at least one parameter of the electronic booster selected from the group consisting of: an identity of the electronic booster, a delay time, a status of the electronic booster, environmental conditions surrounding the electronic booster, a position of the electronic booster, a signal integrity for communication of the electronic booster with an associated blasting machine, and a status of the electronic booster.

10. The electronic booster of claim 8, wherein the logger inputs data into the electronic booster selected from the group consisting of: an identification code for the electronic booster, a firing code for the electronic booster, and a delay time.

11. The electronic booster of claim 1, wherein the transceiver is adapted for receiving said at least one wireless command signal through rock.

12. The electronic booster of claim 11, wherein the at least one wireless command signal comprises low-frequency radio signals comprise radio signals preferably having a frequency of from 20-2500 Hz, preferably 100-2000 Hz, more preferably 200-1200 Hz.

13. The electronic booster of claim 1, wherein the transceiver is adapted for transmitting at least one wireless response signal through rock to said at least one blasting machine.

14. The electronic booster of claim 1, wherein said at least one wireless command signal is selected from the group consisting of: an ARM signal, a FIRE signal, a DISARM signal, a booster activation signal, a booster deactivation signal, a delay time to be stored by one or more components of the electronic booster, a signal to increase an operating voltage of the electronic booster, and a calibration signal to calibrate a clock in the electronic booster.

15. The electronic booster of claim 1, wherein the transceiver is adapted to transmit at least one wireless response signal to said at least one blasting machine, and each of said at least one wireless response signal comprises data selected from the group consisting of: an identification code for an electronic booster, a delay time programmed into said electronic booster, a status of said electronic booster, environmental conditions in a vicinity of said electronic booster, a position of the electronic booster, and a signal integrity for communication of the electronic booster with an associated blasting machine.

16. Use of an electronic booster of claim 1 in a mining operation.

17. A method of establishing and controlling a blasting apparatus at a blast site, the method comprising the steps of:

providing at least one wireless electronic booster of claim 1, together with at least one blasting machine;

positioning the at least one wireless electronic booster at a blast site each in wireless signal communication with at least one of said at least one blasting machine, each booster being in association with explosive material at the blast site;

transmitting to each booster from said associated blasting machine, at least one wireless command signal, thereby to control the at least one booster, said at least one wireless command signal optionally including at least one wireless command signal to FIRE, thereby causing actuation of the at least one booster and detonation of the associated explosive material.

18. The method of claim 17, wherein before or after the step of positioning, the method further includes a step of:

connecting a logger via direct electrical connection or short-range wireless connection to said at least one wireless booster to transmit data to and/or to receive data from, the at least one booster.

19. The electronic booster of claim 18, wherein the at least one wireless response signal comprises low-frequency radio signals preferably having a frequency of from 20-2500 Hz, preferably 100-2000 Hz, more preferably 200-1200 Hz.

20. The method of claim 18, wherein the step of connecting comprises transmitting from a logger to each of said at least one booster data selected from: a delay time, a booster identification code, a firing code.

21. The method of claim 18, wherein the step of connecting comprises receiving by a logger from each of said at least one booster data selected from: a booster identification code, a firing code, a delay time, an environment of each booster, a status of each booster, verification of a communication link with an associated blasting machine.

22. The method of claim 18, wherein the step of positioning comprises robotic placement of each of said at least one booster at the blast site via a robotic means, the logger forming an integral part of the robotic means.

23. The method of claim 17, wherein each of said at least one booster is located underground, and each of said at least one blasting machine is located at or above a surface of the ground, the step of transmitting comprising transmission of command signals comprising low-frequency radio signals, preferably having a frequency of 20-2500 Hz, preferably 100-2000 Hz, more preferably 200-1200 Hz.

24. The electronic booster of claim 1, further comprising an antenna for receiving the at least one wireless command signal, the antenna having a configuration to receive the at least one wireless command signal from any direction, the antenna including a cylindrical or tube-like core member, about which are wound wires.

25. The electronic booster of claim 24, wherein the antenna includes three wire windings of which one is wound in a circular manner about the core member, and the other two are wound in an elliptical manner about the core member.

26. The electronic booster of claim 25, wherein each wire winding comprises from 1 to several thousand windings of fine gauge wire.

* * * * *